US005936210A

United States Patent [19]

Borneby et al.

[11] Patent Number: 5,936,210

[45] Date of Patent: Aug. 10, 1999

[54] HIGH PERFORMANCE MUFFLER

[75] Inventors: Hans Borneby, Niota; Matthew Graves, Greenback; Brian Robert May, Loudon, all of Tenn.

[73] Assignee: Maremont Exhaust Products, Inc., Loudon, Tenn.

[21] Appl. No.: 09/007,850

[22] Filed: Jan. 15, 1998

[51] Int. Cl.[6] ..... F01N 1/08

[52] U.S. Cl. ..... 181/264; 181/273; 181/256

[58] Field of Search ..... 181/264, 265, 181/266, 268, 269, 270, 272, 273, 275, 276, 281, 282, 252, 256

[56] References Cited

U.S. PATENT DOCUMENTS

| | | |
|---|---|---|
| 624,062 | 5/1899 | Mattews et al. . |
| 1,081,348 | 12/1913 | Unke et al. . |
| 1,184,431 | 5/1916 | Dodge . |
| 1,677,570 | 7/1928 | Stade . |
| 1,756,916 | 4/1930 | Stranahan . |
| 1,772,589 | 8/1930 | Beamer . |
| 1,866,004 | 7/1932 | Beamer . |
| 1,946,908 | 2/1934 | Hanson . |
| 1,984,707 | 12/1934 | Sommer . |
| 2,071,351 | 2/1937 | McNamara . |
| 2,239,549 | 4/1941 | Chipley . |
| 2,325,905 | 8/1943 | Caulfield . |
| 2,485,555 | 10/1949 | Bester . |
| 2,667,940 | 2/1954 | Gallihugh . |
| 2,806,548 | 9/1957 | Carroll . |
| 2,934,889 | 5/1960 | Poulos . |
| 2,971,599 | 2/1961 | Tobias . |
| 3,029,895 | 4/1962 | Lyon . |
| 3,029,896 | 4/1962 | Lyon . |
| 3,170,891 | 2/1965 | Flugger . |
| 3,219,141 | 11/1965 | Williamitis . |
| 3,220,508 | 11/1965 | Nordquest et al. . |
| 3,704,763 | 12/1972 | Becker et al. . |
| 3,786,896 | 1/1974 | Foster et al. . |
| 4,143,739 | 3/1979 | Nordie . |
| 4,165,798 | 8/1979 | Martinez . |
| 4,220,219 | 9/1980 | Flugger . |
| 4,315,559 | 2/1982 | Casey . |
| 4,346,783 | 8/1982 | Scarton et al. . |
| 4,359,134 | 11/1982 | Jackson . |
| 4,550,799 | 11/1985 | Flugger . |
| 4,574,914 | 3/1986 | Flugger . |
| 4,809,812 | 3/1989 | Flugger . |
| 5,033,581 | 7/1991 | Feuling . |
| 5,123,502 | 6/1992 | Flugger . |
| 5,444,197 | 8/1995 | Flugger ..... 181/264 |
| 5,739,484 | 4/1998 | Jones ..... 181/264 |

FOREIGN PATENT DOCUMENTS

| | | |
|---|---|---|
| 316875 | 6/1918 | Germany . |
| 86624 | 10/1921 | Germany . |
| 1 180 573 | 8/1961 | Germany . |
| 488847 | 2/1956 | Italy . |
| 285604 | 2/1928 | United Kingdom . |

*Primary Examiner*—Khanh Dang
*Attorney, Agent, or Firm*—McAndrews, Held & Malloy, Ltd.

[57] ABSTRACT

The improved high performance muffler is used to attenuate the sound waves in exhaust gases from internal combustion engines and the like and has a casing, which includes a closed volume defined by side walls, a top wall, a bottom wall and inlet and outlet end caps. The casing also has a defined exhaust gas-flow passageway, which extends between the end caps, which is bounded by upper and lower walls within the casing and the side walls, and which includes inlet and outlet chambers adjacent to the inlet and outlet end caps, respectively. Two spaced apart, gas-flow channels. A gas-flow director assembly, disposed between the side walls and the upper and lower walls, defines two spaced apart gas-flow channels. The gas-flow channels have a uniform, smooth cross-section, and their lengths are substantially equal. The gas-flow director assembly divides the exhaust gases flowing into the gas inlet chamber into two substantially unrestricted and equi-volume gas streams, and also defines an intermediate chamber, which communicates with the gas-flow channels, intermediate their ends, so as to permit the exhaust gases flowing in the channels to expand and mix for sound attenuation. Perforations in the upper and lower walls permit sound waves in the exhaust gases to be attenuated in sound absorption materials disposed in the closed volume of the casing about the gas-flow passageway.

16 Claims, 4 Drawing Sheets

HIGH PERFORMANCE MUFFLER

CROSS REFERENCE TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to mufflers, and more particularly, to high performance mufflers used to attenuate the sound waves in exhaust gases of internal combustion engines and the like (e.g., automotive vehicle engines, turbine engines, compressed gas power tools, etc.).

Exhaust gases from internal combustion engines and the like includes sound waves that many consider objectionable noise. Mufflers have been used for years in attempts to muffle or attenuate the sound waves by modifying and/or eliminating certain of the frequencies of the sound waves. A longstanding goal of those working in the muffler art has been to have the mufflers produce a pleasing sound or tone at an acceptable level.

In the past, various muffler designs or constructions have been proposed and/or used. One commonly used types of muffler design include baffled flow paths for the exhaust gases. Changes in the flow path direction of the exhaust gases, over short distances, caused by the baffles have effectively reduced the noise level. Nevertheless, these baffle-type mufflers have an undesirable side effect of tending to create high back pressure on the engines. Such back pressures reduce the power and efficiency of the engines.

Other muffler designs have directed the exhaust gases through perforated tubes that are surrounded by sound absorbing material, such as glass fibers, commonly known as "glass-pack" or "glass-wool". While these "glass pack" or "glass-wool" type mufflers generally produce lower back pressures on the engine, many find the resulting sound and the level of sound to be objectionable.

So-called "high performance" mufflers have been developed and are recognized by those in the muffler art to be a distinct type or class of muffler. High performance mufflers tend to be smaller or more compact in size than mufflers typically used with conventional automobiles. They usually create a low back pressure on the engine and a level of sound and a tone that are considered pleasing to persons who drive and appreciate high performance automobiles and that are not objectionable to others. Such a high performance muffler is disclosed in U.S. Pat. No. 5,033,581. The patented muffler includes at least two separate gas tubes or passages interconnected in series with a single or multiple tail pipe. At least one of the gas tubes has a length greater than that of the other or others. The total cross-sectional areas of all of the gas tubes are approximately equal to or greater than the cross-sectional area of the single or multiple exhaust manifold or the single or multiple tail pipes. In one embodiment, a housing encloses the gas tubes. In this embodiment, at least one of the gas tubes is perforated, and the space between the gas tubes and the housing is filled with a sound absorbing material.

There remains, however, a recognized need in the muffler art for an improved high performance muffler that can be used with both high performance and conventional automobiles, that will enhance the engine's power and efficiency and that will produce a level of sound and a tone that most will agree is pleasant and acceptable.

BRIEF SUMMARY OF THE INVENTION

In principal aspects, the improved high performance muffler of our present invention includes the unique casing or housing design that enhances engine performance and efficiency, that produces a relatively quiet, pleasing sound, and that is compact and rigid due to a novel system of longitudinal internal supports. This improved muffler includes a exhaust gas-flow passageway, which extends between the inlet end cap and the outlet end cap, and a flow director assembly, which is positioned in the gas-flow passageway and which divides and channels the incoming exhaust gases into two non-restricted gas streams of substantially equal volumes. The flow director assembly converges the two exhaust gas streams back together, adjacent to outlet end cap of the muffler, thereby maintaining the gas flow through the muffler as substantially eddy-free, coherent streams. These two exhaust gas streams are also channeled, in part, by perforated walls that allow the exhaust gases to expand through the perorated openings and flow into sound absorbing material in the casing thereby substantially eliminating the high frequency wavelengths existing in the exhaust gases. Additional sound attenuation is achieved in an intermediate chamber that is defined by the flow director assembly and that permits the exhaust gases flowing in the two streams to mix and expand.

Accordingly, one of the principal objects of the present invention is to provide an improved high performance muffler that produces an acceptable, pleasing sound, that enhances the engine performance and efficiency and that is compact, rigid and relatively easy to manufacture.

Another object of the present invention is to provide an improved high performance muffler for the attenuation of sound waves in the exhaust gases of internal combustion engines and the like, where this improved muffler includes a casing having a first end, second end and a longitudinal centerline that extends through the ends of the casing; where the casing includes a first and second end caps which are disposed generally perpendicular to the longitudinal centerline and which are attached to and close the first and second ends of the casing, respectively, so as to define a closed volume within the casing; where the first end cap has an opening for permitting exhaust gases to flow in the casing; where the second end cap has at least one opening for permitting exhaust gases to flow out of the casing; where a gas-flow passageway is defined in the casing and extends from adjacent to the opening the first end cap to adjacent to each opening in the second end cap; where the gas-flow passageway defines a gas inlet chamber adjacent to the first end cap opening so that the exhaust gases can flow into the inlet chamber through the first end cap opening, and a gas outlet chamber adjacent to the second end cap opening(s) so that the exhaust gases can flow from the outlet chamber through the second end cap opening(s); where a flow director assembly defines a first gas-flow channel, a second gas-flow channel and an intermediate chamber in the gas-flow passageway; where the first gas-flow channel has an inlet end, which is in gas-flow communication with the inlet chamber, an outlet end, which is in gas-flow communication with the outlet chamber, a longitudinal axis, which extends from the inlet end to the outlet end, and a predetermined length; where the second gas-flow channel has an inlet end, which is in gas-flow communication with the inlet chamber, an outlet end, which is in gas-flow communication with the outlet chamber, a longitudinal axis, which extends from the inlet end to the outlet end, and a predetermined length, which is substantially equal to the predetermined length of the first gas-flow channel; where the flow director assembly divides the exhaust gas flowing into the gas inlet chamber into two, substantially unrestricted gas streams that have substantially equal volumes and that flow through the first and second gas-flow channels, respectively; where the intermediate chamber interconnects the first and second gas-flow channels, intermediate their inlet and outlet ends, so as to permit the exhaust gases flowing in the first and second channels to mix and expand into the intermediate chamber thereby providing attenuation of the intermediate frequency wavelength in the sound waves in the exhaust gas; and where means are provided for permitting gas flowing into the first and second gas-flow channels to expand into the closed volume of the casing outside of the gas-flow passageway so as to substantially eliminate the high frequency wavelengths in the sound waves in the exhaust gas. A related object of the present invention is to provide an improved high performance muffler of the type described, where these second end cap includes two openings; where the openings are spaced equidistance from the longitudinal centerline; and where the opening of the first end cap may either be aligned with the longitudinal centerline or may be spaced to one side or the other side of the longitudinal centerline such that when the opening is spaced to one side of the centerline, the opening in the second or outlet end cap will be spaced to the other side of the centerline.

Still another object of the present invention is to provide an improved high performance muffler of the type described, where the casing includes a first side wall, a second wall, a top wall and a bottom wall; where the side, top and bottom walls extend between the first and second end caps; where the gas-flow passageway includes an upper wall, which is adjacent to the top wall, and a lower wall, which is adjacent to the bottom wall and which is spaced from the upper wall; where the upper and lower walls extend between the side walls and between the first and second end caps; and where the flow director assembly is disposed in the space between the lower, upper and side walls and between the inlet and outlet chambers. A related object of the present invention is to provide an improved high performance muffler as described, where the flow director assembly includes a first director and a second director; where the first and second directors each have a generally triangular cross-sectional shape defined by apex defining walls and base defining walls; where the apex of the first director is disposed adjacent to the inlet chamber; where the apex of the second director is disposed adjacent to the outlet chamber; where the base walls of the first and second directors face, but are spaced from each other; where the first and second gas-flow channels are defined between the side walls, the upper and lower walls and the apex defining walls of the first and second directors; and where the intermediate chamber is defined, in part, between the side walls and the base walls of the first and second directors. A further related object of the present invention is to provide an improved high performance muffler as described, where the base walls of the first and second directors include a plurality of openings which permit exhaust gases to flow into the interior of the first and second directors; and where the intermediate chamber includes the interior volumes of the first and second directors, as defined by the side walls, apex defining walls, and the base walls of the directors.

These and other objects, advantages and benefits of the present invention will become more apparent from the following descriptions of the preferred embodiments of our present invention, taken in conjunction with the drawings, which are hereinafter described.

Figure 1:
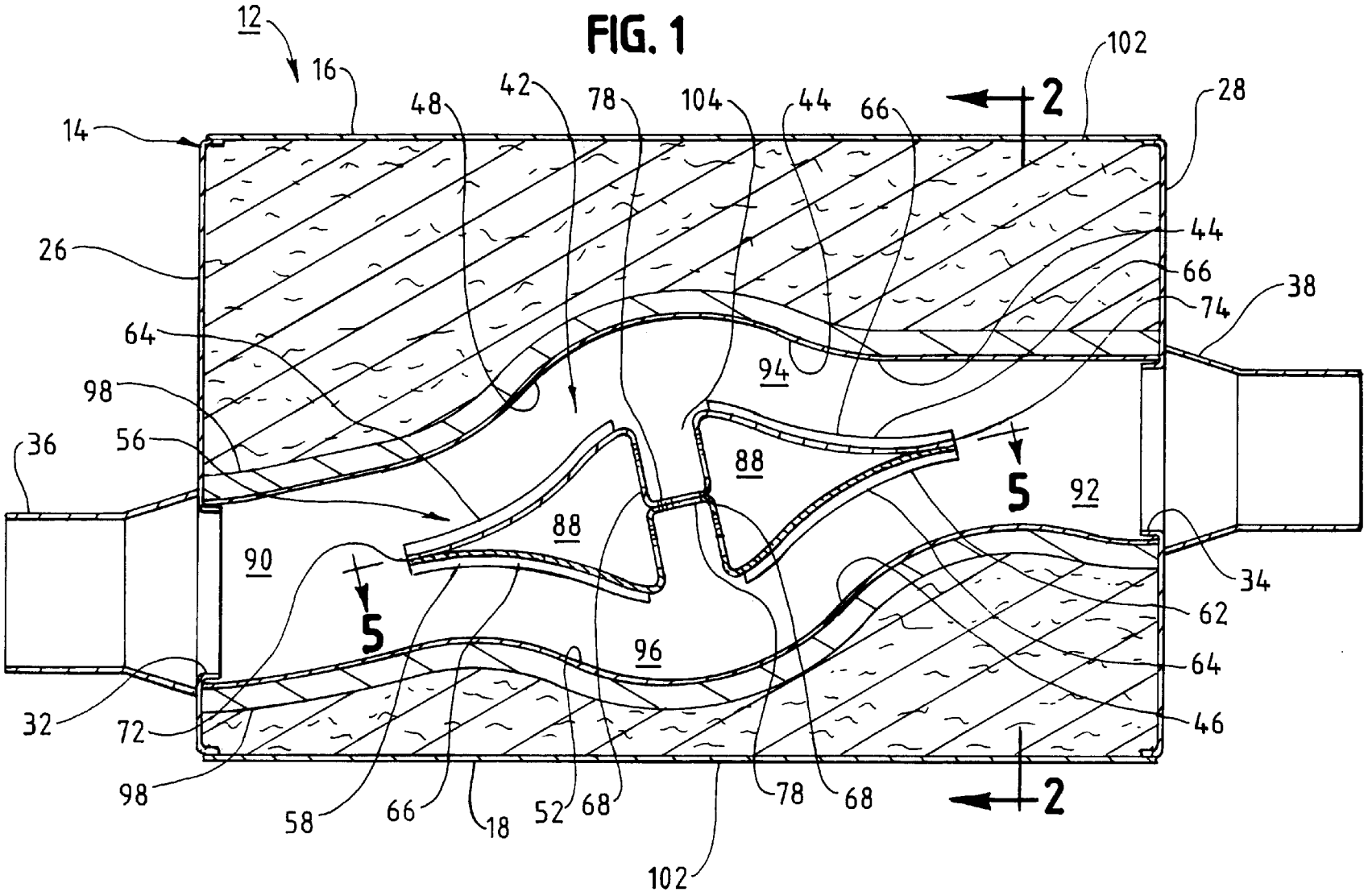
FIG. 1 is a longitudinal, cross-sectional view of an embodiment of the improved high performance muffler of the present invention, taken along a vertical plane that includes the longitudinal centerline of the casing of the muffler.

In the specification and claims for our invention, the terms, "top", "bottom", "side", "upper", "lower", "right", "left" and the like directional terms are used to facilitate describing the preferred embodiments of our invention, as shown in the above described drawings that illustrate those embodiments. These terms should not, however, be construed as limiting the scope of our invention, particularly as described in the claims, since for example, the "top" of a muffler can become the "bottom" by turning it over, and its "sides" can become its "top" and "bottom" by turning the muffler ninety degrees from the position shown in the drawings.

Additionally in the specification, the same reference numbers have been used to identify the same or comparable parts, components, etc. in the descriptions of the several embodiments of our invention.

DETAILED DESCRIPTION OF THE PREFERRED EMBODIMENTS OF THE INVENTION

Figure 2:
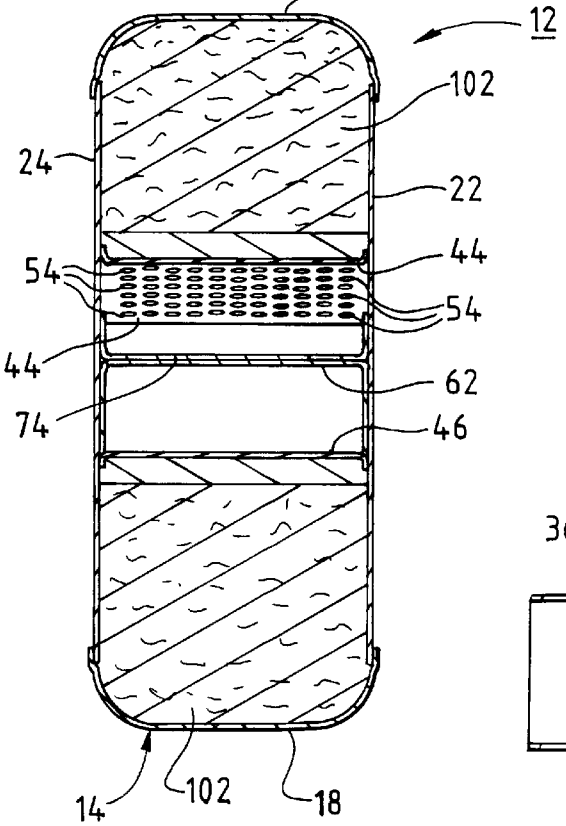
FIG. 2 is a cross-sectional view taken along the line 2—2 of FIG. 1.

Referring now to FIGS. 1 and 2, a preferred embodiment of the improved high performance muffler of our present invention is shown generally at 12. The muffler has a welded metal casing or housing 14 that includes a top wall 16, a bottom wall 18, first side wall 22 and a second side wall 24. The casing walls may be made from any of the metals that are conventionally used with mufflers. Additionally, the casing 14 can be made from a single wrapped wall.

The top and bottom walls 16 and 18 have curved, side edge portions that are joined, by welding, to the adjacent edges of the side walls 22 and 24 so that, as best shown in FIG. 2, the overall cross-sectional shape of the casing 14 is generally rectangular. The left and right ends of the casing 14 (as shown in FIG. 1) are closed by an inlet end cap 26 and an outlet end cap 28, respectively. These end caps are joined, by welding, about their peripheral edges with the top wall 16, bottom wall 18 and side walls 22 and 24 so that the interior of the casing 14 is a gas tight volume and is closed except as hereinafter noted. As with the walls 16, 18, 22 and 24, the end caps 26 and 28 may be made from any of the metals that are conventionally used with mufflers.

The casing 14 has a central longitudinal axis, which is equidistance between the planes of the top and bottom walls 16 and 18 and between the planes of the side walls 22 and 24 and which extends between the left and right ends of the casing 14. The inlet end cap 26 has an inlet opening 32 that is offset, toward the bottom wall 18, from the longitudinal centerline. The outlet end cap 28 has an outlet opening 34 that is coaxial with the longitudinal centerline.

A tubular metal inlet fitting 36 is joined, by welding, at its expanded end to the inlet end cap 26 so that its expanded end surrounds the inlet opening 32. Similarly, a tubular metal outlet fitting 38 is joined, by welding, at its expanded end to the outlet end cap 28 so that its expanded end surrounds the outlet opening 34. The other ends of the fittings 36 and 38 are adapted to be connected with a conventional engine exhaust pipe and a tail pipe (not shown), respectively.

A gas-flow passageway 42 is defined within the casing 14 by upper and lower walls 44 and 46. More specifically, the passageway 42 is defined between the upper wall, 44, the lower wall 46, the end caps 26 and 28 and the side walls 22 and 24. The gas-flow passageway is intended to permit exhaust gases, which are introduced into the interior of the casing 14 through the inlet opening 32, to flow through the casing 14 and out the outlet opening 34.

The upper wall 44 is adjacent to the top wall 16 while the lower wall 46 is adjacent to the bottom wall 18. These walls 44 and 46 are joined, by welding, along their side edges to the side walls 22 and 24, and at their ends, to the end caps 26 and 28, adjacent to the upper and lower edges of the openings 32 and 34, respectively. The walls 44 and 46 have generally centrally disposed curved sections 48 and 52, respectively that are located and arranged so that the concave portion of the curved sections generally face one another.

The upper and lower walls 44 and 46 both include a number of relatively small, evenly spaced perforated openings or apertures 54. The openings are along substantially the entire lengths and widths of the walls 44 and 46. In a muffler 12 where, for example, the length (that is, the distance between the end cap 26 and 28) and the height (that is, the distance between the walls 16 and 18) of the muffler are 14.0 and 10.42 inches, respectively, the perforated openings have a diameter of 0.25 inches and the spacing, between their centers is 0.50 inches. Notwithstanding the perforated openings 54, the facing surfaces of the walls 46 and 48 (that is, the lower facing surface of wall 46 and the upper facing surface of wall 48) are smooth so that exhaust gases can flow smoothly through the passageway 42.

A flow director or diverter assembly 56 is disposed within the gas-flow passageway 42 adjacent to and between the curved sections 48 and 52 of the walls 44 and 46. The assembly 56 extends between the side walls 22 and 24 and is joined, by welding, to the side walls.

One of the advantages of the muffler 12 is that the structure of the casing 14 is very rigid and durable because of its unique longitudinal supporting system. Not only are the walls 16, 18, 22 and 24 and the end caps 26 and 28 welded together, but the walls 44 and 46 extend between the side walls 22 and 24 and the end caps 26 and 28 so as to further internally support and reinforce the casing. The assembly 56 similarly supports and reinforces the side walls 22 and 24 and adds to the overall rigidity of the casing 14.

The flow director assembly 56 includes a inlet flow director or diverter 58 and an outlet flow director or diverter 62. As shown in FIG. 1, both directors are generally triangular in cross-sectional shape. Each of the directors 58 and 62 is defined by a pair of apex defining walls 64 and 66 and a base wall 68. The walls 64 and 66 for each director define, at their apex, an apex edge that also extends between the side walls 22 and 24. The apex edge 72 of the inlet director 58 points generally toward the inlet opening 32. The apex edge 74 of the director 62 points generally toward the outlet opening 34. The base defining walls 68 of the directors 58 and 62 are spaced from each other but generally face one another.

Figure 5:
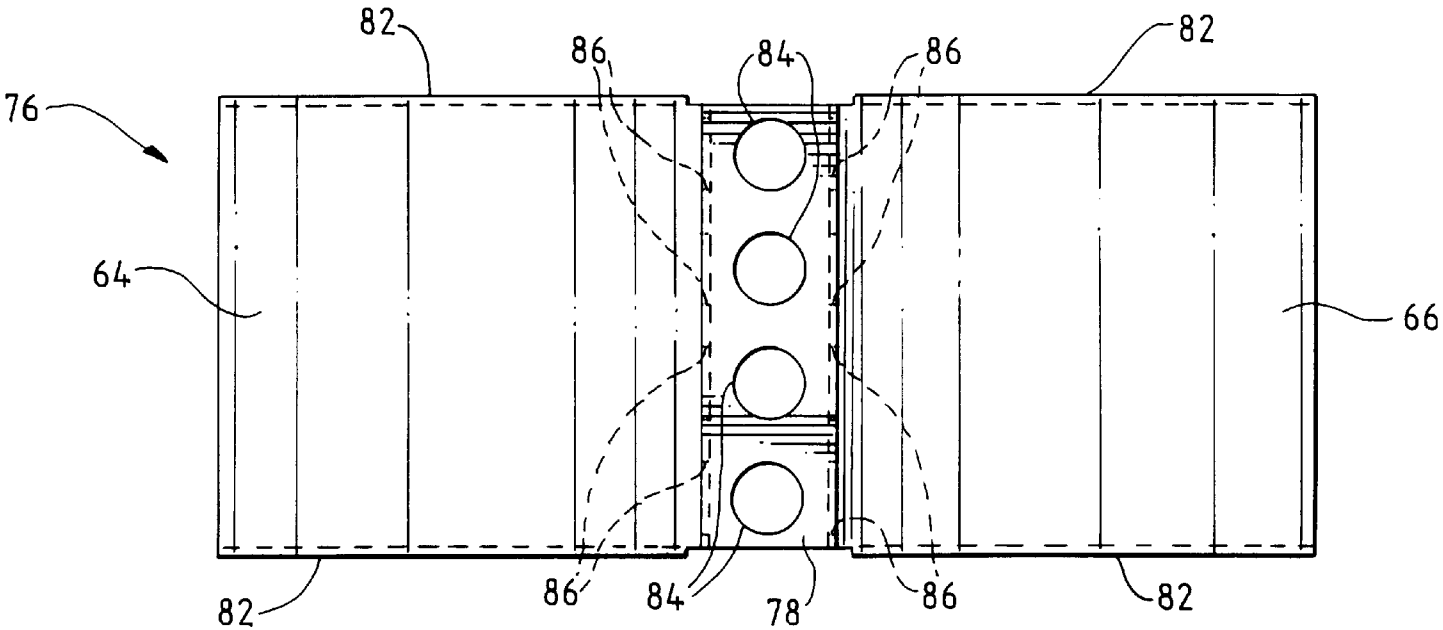
FIG. 5 is a plan view taken along the line 5—5 of FIG. 1.
Figure 6:
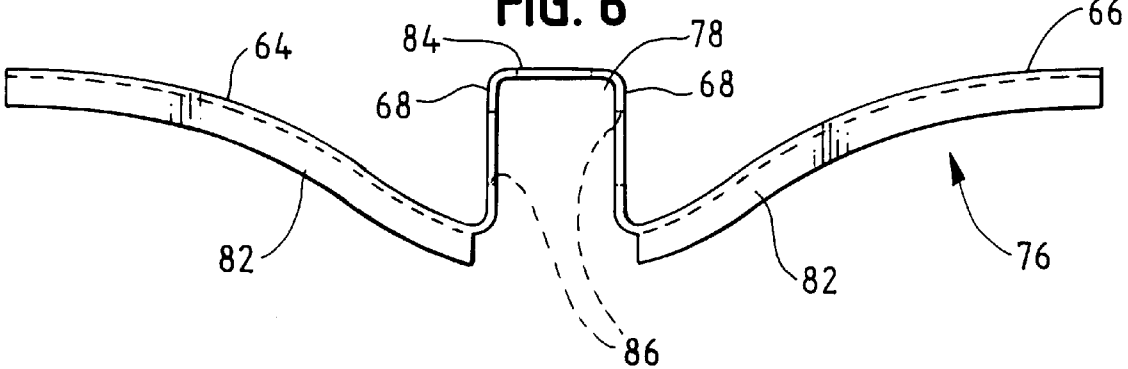
FIG. 6 is a plan view of the walls that may be used to construct the first and second flow directors of the present invention.

As best shown in FIGS. 5 and 6, the flow directors 58 and 62 may be constructed by using a pair of identical, combined walls 76 that include an apex defining wall 64 for one director 58 or 62, an apex defining wall 66 for the other director 62 or 58, and one half of the base defining walls 62 for each of the directors. The walls 76 each also include a joining portion 78. The directors 58 and 62 are constructed by placing the walls 76 so that their joining portions 78 are in back to back contact, as shown in FIG. 1. The walls 76 include flange portions 82 that are adjacent to each of their side edges and that abut and are welded to the side walls 22 and 24.

The joining portions 78 of each director wall 76 include four evenly spaced, defuser holes 84 that have the same diameter. The holes 84 are aligned when the directors 58 and 62 are assembled as shown in FIG. 1 so that exhaust gases may pass through the holes 84 from one side of the back to back portions 78 to the other.

Each half of the base defining wall 68, which form parts of a wall 76, includes four equi-spaced, equi-diameter defuser holes 86 so that when the assembly 56 is constructed, as shown in FIG. 1, the base defining walls 68 of the directors 58 and 62 each include eight holes 86. The holes 86 of the two directors are substantially aligned axially. As a result of their construction, the directors 58 and 62 are "hollow" in the sense that the apex defining walls 64 and 66 and the base defining walls 68 of each define an interior triangular chamber 88.

As shown in FIG. 1, the inlet and outlet apex edges 72 and 74 of the directors 58 and 62 are spaced from the inlet opening 32 and outlet opening 34, respectively. An inlet chamber 90 is defined in the gas passageway 42 between the inlet apex edge 72 and the inlet opening 32. Similarly, an outlet chamber 92 is defined in the gas-flow passageway 42 between the outlet apex edge 74 and the outlet opening 34.

The flow director assembly 56 divides the passageway 42, between the inlet and outlet chambers 90 and 92, into two channels 94 and 96 that have substantially equal cross-sectional areas. More specifically, the spacings of the apex defining walls 64 and 66, with respect to the adjacent upper and lower walls 44 and 46 are pre-selected so that the cross-sectional areas of the channels 94 and 96 remain the same, except for the portion adjacent to the base defining walls 68. The inlet apex edge 72 causes exhaust gases, flowing into the inlet chamber 90 through the inlet opening 32, to be divided into two substantially unrestricted gas streams of substantially equal volumes, which then flow, with substantially no restriction through the channels 94 and 96. The gas streams are re-united or are merged together, after passing the outlet apex edge 74, so as to maintain a substantially eddy-free exhaust gas stream in the outlet chamber 92. The re-united exhaust gas stream then passes out through the outlet opening 34 and the fitting 38.

The openings 54 in the walls 44 and 46 permit exhaust gases to expand through the openings into the closed volume defined by the walls 16, 18, 22, 24, 44 and 46 and the end caps 26 and 28. Sound absorbing materials are disposed in this closed volume to assist in essentially eliminating the high frequency wavelengths existing in the exhaust gases.

As shown in FIG. 1, the sound absorbing materials may include a layer of conventional stainless steel wool needle mat 98, which is disposed adjacent to the walls 44 and 46, and basact fiber or long strand fiberglass 102, which is disposed between the needle mat material 98 and the walls 16 and 18.

The third, intermediate chamber 104 is defined,. in the gas-flow passageway 42 between the base defining walls 68 and includes the interior chambers 88 of the inlet and outlet directors 58 and 62. Because of the defuser holes 84 and 86, the exhaust gases, flowing in the gas streams (as defined by the channels 94 and 96), may also flow into intermediate chamber 104 where the gases will mix and expand. This mixing and expansion in the intermediate chamber results in substantial sound attenuation, and more particularly eliminates high frequency wavelengths in the sound waves in the gases.

In sum, the structure of the flow director assembly 56, in cooperation of the structure of the walls 44 and 46, divides the exhaust gases into two non-restricted, equi-volume gas streams and also converges the streams back together again in the outlet chamber 92 so as to minimize the back pressure of the exhaust system.

The improved high performance muffler of the present invention can be constructed to accommodate various exhaust pipe and tail pipe configurations. In FIG. 1, as noted, the centerline of the outlet opening of 34 in outlet end cap 28 is co-axial with the longitudinal centerline of the casing 14 while the centerline of the inlet opening 32 of the inlet end cap 26 is offset, toward the bottom wall 18, from the casing's longitudinal centerline.

Figure 3:
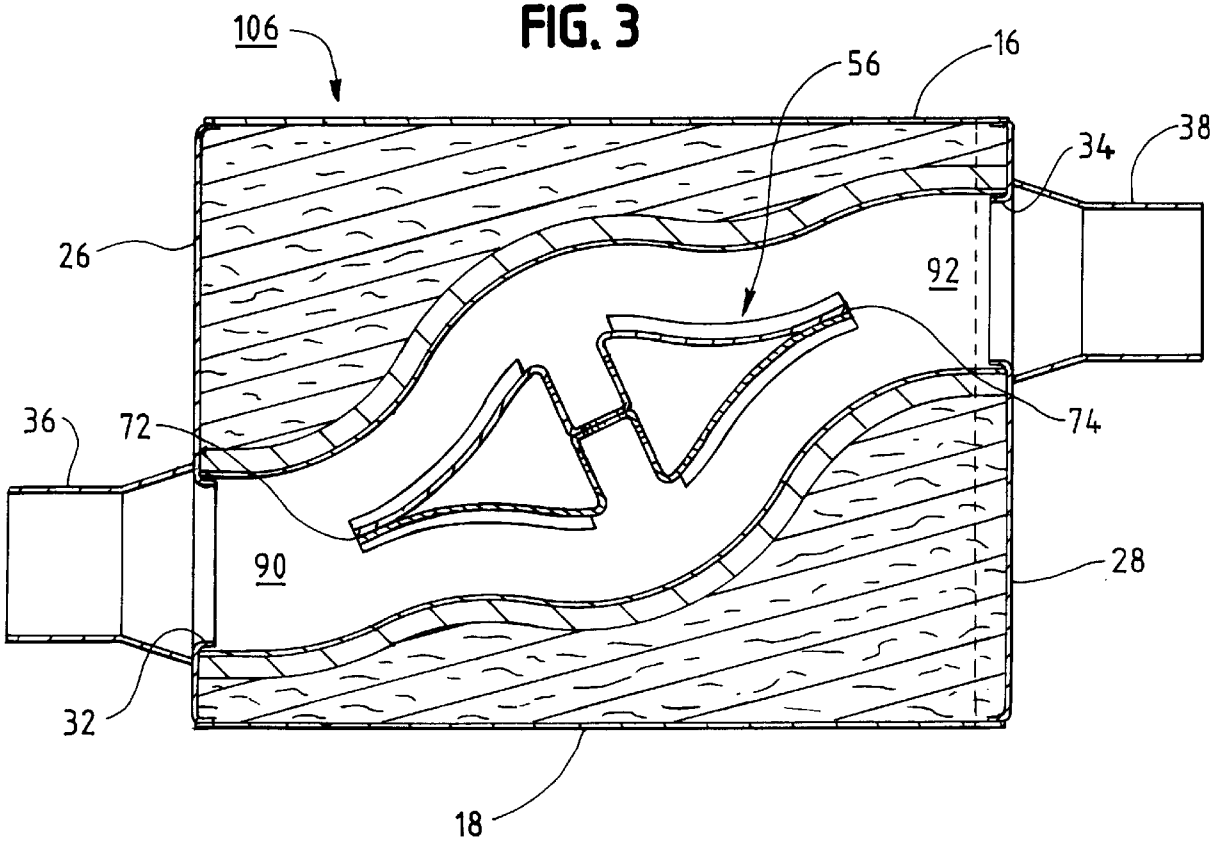
FIG. 3 is a longitudinal cross-sectional view similar to the view of FIG. 1, of another embodiment of the present invention.

The muffler 106 shown in FIG. 3 is structurally and functionally identical to the muffler 12, shown in FIGS. 1 and 2, except that the centerline of the outlet opening 34 is also offset from the longitudinal centerline of the casing. The direction of offset of the opening 34 is opposite to that of the offset of the inlet opening 32 (that is, toward the top wall 16). Both openings 32 and 34 may be offset the same distance.

Figure 4:
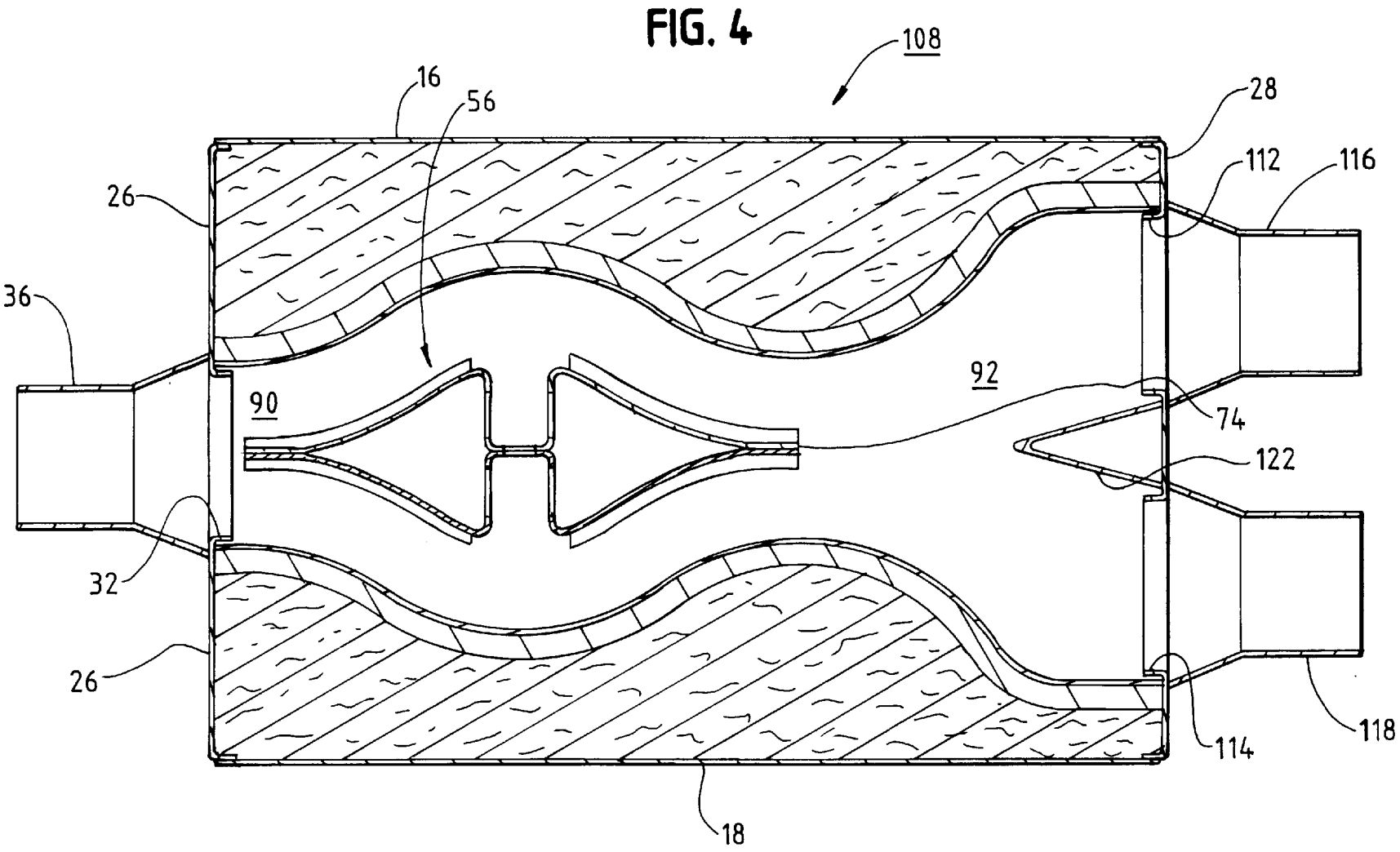
FIG. 4 is a longitudinal cross-sectional view, similar to the views of FIGS. 1 and 3, of still another embodiment of the present invention.

The muffler 108 shown in FIG. 4 is structurally and identical to the mufflers 12 and 106 except that the chamber 92 is has a larger volume than that of the chamber 90 so to accommodate two outlet openings 112 and 114 in the outlet end cap 28 and two outlet fitting 116 and 118 which are each identical to the fitting 38. A triangular shaped member 122 is disposed mounted on the left facing surface of the end cap 28, between the outlet openings 112 and 114. The apex end of the member 122 faces the outlet apex edge 74. The openings 112 and 114 are offset from the central longitudinal axis of the muffler 108 by an equal distance. Additionally, the centerline of the inlet opening 118 in the inlet end cap 26 is aligned with the central longitudinal axis of the muffler 108.

The preferred embodiments of our invention have been described and are illustrative of our invention. It should be understood, however, that our invention is not limited to this preferred embodiments. It is therefore contemplated that the appended claims will define the scope of the invention for which we seek protection.

We claim:

1. An improved high performance muffler for use in the attenuation of sound waves in exhaust gases that are from internal combustion engines and the like, the improved muffler comprising:

a casing that has a first end and a second end, that has a longitudinal centerline, which extends through the first and second ends of the casing and that includes a first inlet end cap and a second outlet end cap, which end caps are disposed generally perpendicular to the longitudinal centerline and which are attached to and close the first and second ends of casing, respectively, so as to define a closed volume within the casing; the first end cap having an opening therein for permitting exhaust gases to flow into the casing; and the second end cap having at least one opening therein for permitting exhaust gases to flow out of the casing;

an exhaust gas-flow passageway defined in the casing, the gas-flow passageway extending from adjacent to the opening in the first end cap to adjacent to each opening in the second end cap; the gas-flow passageway including a gas inlet chamber, which is adjacent to the first end cap opening so that exhaust gases can flow into the gas inlet chamber through the first end cap opening, and a gas outlet chamber, which is adjacent to each second end cap opening so that exhaust gases can flow from the outlet chamber through each second end cap opening;

a gas-flow director assembly defining a first gas-flow channel, a second gas-flow channel, and an intermediate chamber in the gas-flow passageway; the first gas-flow channel having an inlet end, which is in gas-flow communication with the inlet chamber, an outlet end, which is in gas-flow communication with the outlet chamber, a longitudinal axis, which extends from the inlet end to the outlet end, and a predetermined length; the second gas-flow channel having an inlet end, which is in gas-flow communication with the inlet chamber, an outlet end, which is in gas-flow communication with the outlet chamber, a longitudinal axis, which extends from the inlet end to the outlet end, and a predetermined length, which is substantially equal to the predetermined length of the first gas-flow channel; the flow director assembly dividing the exhaust gases flowing into the gas inlet chamber into two, substantially unrestricted gas streams that have substantially equal volumes and that flow through the first and second gas-flow channels, respectively; the intermediate chamber interconnecting the first and second gas-flow channels, intermediate their inlet and outlet ends, so as to permit the exhaust gases flowing in the first and second gas-flow channels to mix and expand into the intermediate chamber thereby providing attenuation of the intermediate frequency wavelengths in the sound waves in the exhaust gases; and means for permitting exhaust gases flowing in the first and second gas-flow channels to expand into the closed volume outside of the gas-flow passageway so as to substantially eliminate the high frequency wavelengths in the sound waves in the exhaust gas.

2. The improved high performance muffler of claim 1 wherein the flow permitting means includes a plurality of relatively small perforations in the gas-flow passageway whereby the perforations permit the exhaust gases to escape generally laterally with respect to the longitudinal axis of the channels.

3. The improved high performance muffler of claim 2 wherein the flow permitting means includes sound absorbing material that is disposed in the closed volume of the casing, outside of gas-flow passageway.

4. The improved high performance muffler of claim 1 wherein the second end cap includes two openings that are spaced equidistance from the longitudinal centerline; and wherein the first end cap has one opening that is aligned with the longitudinal centerline.

5. The improved high performance muffler of claim I wherein the first and second end caps each include one opening; and wherein at least one of the openings is spaced from the longitudinal centerline.

6. The improved high performance muffler of claim 5 wherein both of the openings are spaced from the longitudinal centerline.

7. The improved high performance muffler of claim 1 wherein the casing includes a first side wall, a second side wall, a top wall and a bottom wall; wherein the first side wall, the second side wall, the top wall and the bottom wall extend between the first and second end caps; wherein the passageway includes an upper wall, which is adjacent to the top wall, and a lower wall, which is adjacent to the bottom wall and which is spaced from the upper wall; wherein the upper and lower walls extend between the first and second side walls and between the first and second end caps; and wherein the flow director assembly is disposed in the space between the upper, lower and side walls and between the inlet and outlet chambers.

8. The improved high performance muffler of claim 7 wherein the first and second side walls are generally parallel; wherein the top and bottom walls are generally parallel; and wherein the flow permitting means includes a plurality of relatively small perforations in the upper and lower walls whereby the perforations permit exhaust gases to escape generally laterally from the space between the upper and lower walls.

9. The high performance muffler of claim 7 wherein the flow director assembly includes a first director and a second director; wherein the first and second directors each has a generally triangular cross-sectional shape defined by apex defining walls and base defining walls; wherein the apex of the first director is disposed adjacent to the inlet chamber; wherein the apex of the second director is disposed adjacent to the outlet chamber; wherein the base walls of the first and second directors face, but are spaced from each other; wherein the first channel is defined between the side walls, the upper wall and the apex defining walls that are adjacent to the upper wall; wherein the second channel is defined between the side walls, the lower wall and the apex defining walls that are adjacent to the lower wall; and wherein the intermediate chamber is defied, in part, between the side walls and the base walls of the first and second directors.

10. The improved high performance muffler of claim 9 wherein the base walls of the first and directors include a plurality of openings that permit exhaust gases to flow into the interior of the first and second directors; and wherein the intermediate chamber includes the interior volumes of the first and second directors as defined by the side walls, apex defining walls, and the base walls.

11. The improved high performance muffler of claim 10 wherein the side walls are generally parallel; wherein the top and bottom walls are generally parallel; wherein the flow permitting means includes a plurality of relatively small, generally uniformly spaced perforations in the upper and lower walls whereby the perforations permit exhaust gases to escape generally laterally from the inlet and outlet chambers and from the first and second channels; and wherein the channel defining sides of the upper, lower and apex defining walls are substantially smooth.

12. The improved high performance muffler of claim 11 wherein the flow permitting means includes sound absorbing materials that is disposed in the closed volume of the casing outside of the gas-flow passageway.

13. The improved high performance muffler of claim 11 wherein the second end cap includes two openings, which are spaced equidistance from the longitudinal centerline; and wherein the first end cap has one opening, which is aligned with the longitudinal centerline.

14. The improved high performance muffler of claim 11 wherein the first and second end caps each have one opening; and wherein at least one of the openings is spaced from the longitudinal centerline.

15. The improved high performance muffler of claim 14 wherein both of the openings are spaced from the longitudinal centerline.

16. The improved high performance muffler of claim 11 wherein the opening in the first end cap is spaced from the longitudinal centerline selectively toward one of the top or bottom walls; and wherein the opening in the second end cap is spaced from the longitudinal centerline selectively toward one of the bottom or top walls.

* * * * *